US009607753B2

(12) United States Patent
Jeong et al.

(10) Patent No.: US 9,607,753 B2
(45) **Date of Patent: *Mar. 28, 2017**

(54) MULTILAYER INDUCTOR

(71) Applicant: SAMSUNG ELECTRO-MECHANICS CO., LTD., Suwon-Si, Gyeonggi-Do (KR)

(72) Inventors: Dong Jin Jeong, Busan (KR); Hyeog Soo Shin, Busan (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/806,565

(22) Filed: Jul. 22, 2015

(65) Prior Publication Data

US 2015/0325360 A1 Nov. 12, 2015

Related U.S. Application Data

(62) Division of application No. 14/311,040, filed on Jun. 20, 2014, now Pat. No. 9,349,525, which is a division
(Continued)

(30) Foreign Application Priority Data

Dec. 28, 2011 (KR) ..... 10-2011-0144812

(51) Int. Cl.
*H01F 5/00* (2006.01)
*H01F 27/28* (2006.01)
(Continued)

(52) U.S. Cl.
CPC ..... *H01F 27/29* (2013.01); *H01F 3/14* (2013.01); *H01F 17/0033* (2013.01);
(Continued)

(58) Field of Classification Search
CPC ..... H01F 2027/2809
(Continued)

(56) References Cited

U.S. PATENT DOCUMENTS 6,515,568 B1 2/2003 Maki et al.
7,605,682 B2 10/2009 Nakao et al.
(Continued)

FOREIGN PATENT DOCUMENTS

CN 101356599 A 1/2009
CN 102292782 A 12/2011
(Continued)

OTHER PUBLICATIONS

Notice of Allowance Korean Patent Application No. 10-2011-0144812 dated Aug. 26, 2013.
(Continued)

*Primary Examiner* — Elvin G Enad
*Assistant Examiner* — Ronald Hinson
(74) *Attorney, Agent, or Firm* — McDermott Will & Emery LLP

(57) ABSTRACT

Disclosed herein is a multilayer inductor. The multilayer inductor according to an exemplary embodiment of the present invention includes a laminate on which a plurality of body sheets are multilayered; a coil part configured to have internal electrode patterns formed on the body sheet; a first gap made of a non-magnetic material located between the multilayered body sheets; a second gap made of a dielectric material located between the multilayered body sheets and located on a layer different from the first gap; and external electrodes formed on both surfaces of the laminate and electrically connected with both ends of the coil part. By this configuration, the exemplary embodiment of the present invention can remarkably improve DC biased characteristics without reducing breaking strength of the inductor.

7 Claims, 6 Drawing Sheets

Related U.S. Application Data of application No. 13/730,679, filed on Dec. 28, 2012, now abandoned.

(51) Int. Cl.
*H01F 27/29* (2006.01)
*H01F 3/14* (2006.01)
*H01F 17/00* (2006.01)

(52) U.S. Cl.
CPC ..... *H01F 27/2804* (2013.01); *H01F 27/292* (2013.01); *H01F 2027/2809* (2013.01)

(58) Field of Classification Search
USPC ..... 336/200
See application file for complete search history.

(56) References Cited

U.S. PATENT DOCUMENTS

| | | | | |
|---|---|---|---|---|
| 7,719,398 | B2 | 5/2010 | Tsuzuki | |
| 2007/0182519 | A1 | 8/2007 | Tsuzuki et al. | |
| 2008/0218301 | A1 | 9/2008 | Yamaguchi | |
| 2009/0051474 | A1* | 2/2009 | Lee | H01F 3/14 336/83 |
| 2010/0108233 | A1 | 5/2010 | Sato et al. | |
| 2011/0133881 | A1 | 6/2011 | Nakajima et al. | |
| 2011/0279213 | A1 | 11/2011 | Tsuduki et al. | |
| 2012/0268230 | A1 | 10/2012 | Kim et al. | |
| 2013/0043970 | A1* | 2/2013 | Poddar | H01F 27/36 336/84 C |
| 2014/0300441 | A1* | 10/2014 | Jeong | H01F 27/2804 336/192 |

FOREIGN PATENT DOCUMENTS

| | | | |
|---|---|---|---|
| JP | 2010-109281 | A | 5/2010 |
| KR | 10-2009-0033378 | A | 4/2009 |
| KR | 10-2011-0086753 | A1 | 7/2010 |
| KR | 10-2011-0018954 | | 2/2011 |

OTHER PUBLICATIONS

Office Action dated Feb. 3, 2015, which issued in related Chinese Patent Application No. 201210580747X.
Office Action issued in U.S. Appl. No. 13/730,679 dated Oct. 28, 2013.
Office Action issued in U.S. Appl. No. 13/730,679 dated Mar. 20, 2014.
Final Office Action issued in U.S. Appl. No. 14/311,040 dated Jul. 9, 2015.
Office Action issued in U.S. Appl. No. 14/311,040 dated Mar. 11, 2015.
Decision of Rejection Chinese Patent Application No. 201210580747.X dated May 5, 2016 with English translation.

* cited by examiner

MULTILAYER INDUCTOR

CROSS REFERENCE(S) TO RELATED APPLICATIONS

This application is a Divisional of U.S. patent application Ser. No. 14/311,040, filed on Jun. 20, 2014 which is a Divisional of U.S. patent application Ser. No. 13/730,670, filed Dec. 28, 2012, claiming priority of Korean Patent Application No. 10-2011-0144812, filed on Dec. 28, 2011, the entire contents of each of which are hereby incorporated by reference.

BACKGROUND OF THE INVENTION

1. Technical Field

The present invention relates to an inductor, and more particularly, to a multilayer inductor forming a coil part by multilayering a plurality of body sheets on which internal electrode patterns are printed.

2. Description of the Related Art

A multilayer inductor mainly used for a power supply circuit such as a DC-DC converter within portable devices has been developed to be small and implement high current, low DC resistance, or the like. Recently, as a demand for a high-frequency and small DC-DC converter is increased, a use of a multilayer inductor instead of the existing wound coil has been increased.

The multilayer inductor is configured of a laminate in which a magnetic part multilayered in a plurality of layers and a non-magnetic layer inserted into the magnetic part are complex and has a structure in which an internal coil of a conductive metal is formed in the magnetic part or the non-magnetic part and a punching hole is formed in each layer to connect with the plurality of layers.

As the magnetic body used for the multilayer inductor, ferrite including Ni, Zn, Cu, or the like, may be generally used and as the non-magnetic body, ferrite including Zn and Cu, Zr, or glass including $TiO_3$, $SiO_2$, $Al_2O_3$, or the like, may be generally used.

As such, the multilayer inductor causes degradation in inductance (degradation in DC biased characteristics) due to magnetic saturation of the magnetic body according to the increase in current. To solve the above problem, a method for increasing the DC biased characteristics by inserting the non-magnetic body in the same horizontal direction as a direction in which the magnetic body is multilayered has been used.

However, the non-magnetic body may be diffused to the magnetic body and thus, a loss coefficient of a material may be increased. Further, it is impossible to make a thickness of the non-magnetic body thin due to the diffusion to the magnetic body.

In addition, to solve the diffusion problem, a dielectric material may be inserted into the inductor, but coupling strength is reduced due to non-sintering and thus, breaking strength of the inductor may be reduced.

SUMMARY OF THE INVENTION

An object of the present invention is to provide a multilayer inductor capable of improving breaking strength and DC biased characteristics by complexly using a gap of a non-magnetic material and a gap of a dielectric material.

According to an exemplary embodiment of the present invention, there is provided a multilayer inductor, including: a laminate on which a plurality of body sheets are multilayered; a coil part configured to have internal electrode patterns formed on the body sheet; a first gap made of a non-magnetic material located between the multilayered body sheets; a second gap made of a dielectric material located between the multilayered body sheets and located on a layer different from the first gap; and external electrodes formed on both surfaces of the laminate and electrically connected with both ends of the coil part.

The first gap may be formed to have a thickness sufficient to contact internal electrode patterns located on a top portion thereof and the internal electrode patterns located on a bottom portion thereof, simultaneously.

The first gap may be located to contact the internal electrode patterns located on the top portion thereof.

The second gap may be formed from a center of the coil part to an inner side thereof.

The second gap may be formed from a center of the coil part to an outer side thereof.

The second gap may be printed on any one of a top surface and a bottom surface of the body sheet.

According to another exemplary embodiment of the present invention, there is provided a multilayer inductor, including: a laminate on which a plurality of body sheets are multilayered; a coil part configured to have internal electrode patterns formed on the body sheet; a first gap made of a non-magnetic material located between the multilayered body sheets; a second gap made of a dielectric material located between the multilayered body sheets and located on the same layer as the first gap; and external electrodes formed on both surfaces of the laminate and electrically connected with both ends of the coil part.

The first gap may be located at both ends of the second gap.

The second gap may be formed from a center of the coil part to an outer side thereof.

The second gap may be formed from a center of the coil part to an inner side thereof.

The second gap may be located at both ends of the first gap.

The first gap may be formed from a center of the coil part to an outer side thereof.

The first gap may be formed from a center of the coil part to an inner side thereof.

The first gap may be formed to have a thickness sufficient to contact internal electrode patterns located on a top portion thereof and the internal electrode patterns located on a bottom portion thereof, simultaneously.

The second gap may be formed to have a thickness sufficient to contact internal electrode patterns located on a top portion thereof and the internal electrode patterns located on a bottom portion thereof, simultaneously.

DESCRIPTION OF THE PREFERRED EMBODIMENTS

Hereinafter, exemplary embodiments of the present invention will be described with reference to the accompanying drawings. However, the exemplary embodiments are described by way of examples only and the present invention is not limited thereto.

In describing the present invention, when a detailed description of well-known technology relating to the present invention may unnecessarily make unclear the spirit of the present invention, a detailed description thereof will be omitted. Further, the following terminologies are defined in consideration of the functions in the present invention and may be construed in different ways by the intention of users and operators. Therefore, the definitions thereof should be construed based on the contents throughout the specification.

As a result, the spirit of the present invention is determined by the claims and the following exemplary embodiments may be provided to efficiently describe the spirit of the present invention to those skilled in the art.

Figure 1:
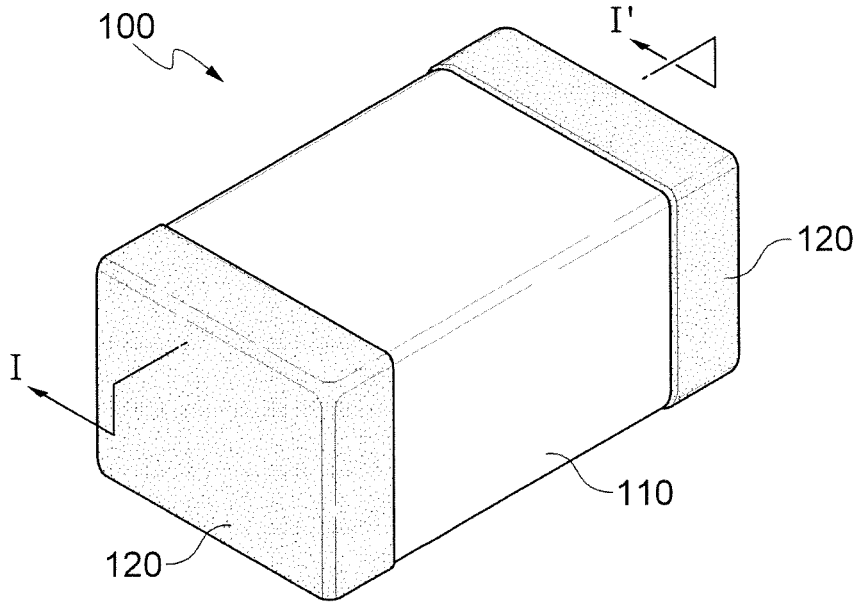
FIG. 1 is a perspective view of a multilayer inductor according to an exemplary embodiment of present invention.
Figure 2:
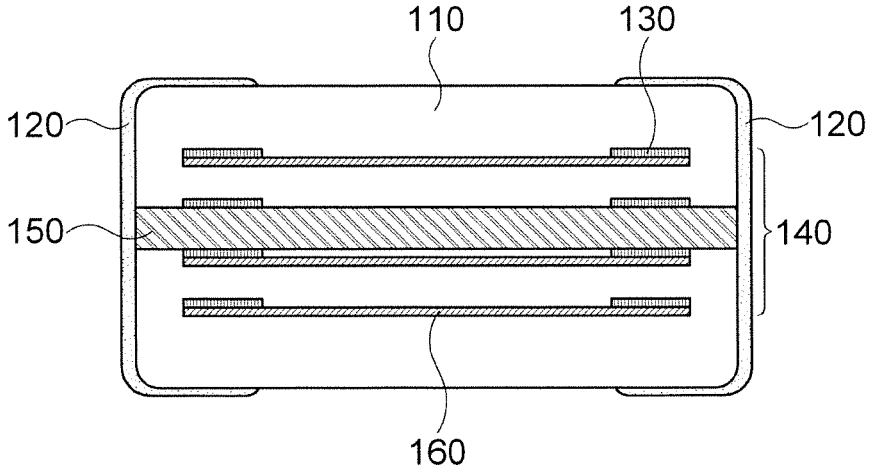
FIG. 2 is a cross-sectional view taken along line I-I' of FIG. 1.

FIG. 1 is a perspective view of a multilayer inductor 100 according to an exemplary embodiment of present invention and FIG. 2 is a cross-sectional view taken along line I-I' of FIG. 1. Referring to FIGS. 1 and 2, the multilayer inductor 100 according to an exemplary embodiment of the present invention may include a laminate 110, a coil part 140, a first gap, a second gap, and external electrodes 120.

The laminate 110 is formed by multilayering a body sheet of a ferrite material in several layers. Generally, ferrite, which is a material such as ceramic having magnetism, has large transparency for magnetic field and high electric resistance and thus, has been used for various kinds of electronic components.

The body sheet is made of a thin plate shape and a top surface of the body sheet is formed with internal electrode patterns 130. The internal electrode patterns 130 are vertically assembled by multilayering the body sheet in several layers and a coil part 140 is made through the assembled internal electrode patterns 130.

Further, both surfaces of the laminate 110 are provided with the external electrodes 120, wherein the external electrodes 120 are electrically connected with both ends of the coil part. The coil part 140 located in the laminate 110 is electrically connected with the outside through the external electrodes 120.

Meanwhile, the first gap 150 is located between the multilayer body sheets and is made of a non-magnetic material. The first gap 150 lowers effective permeability of ferrite and delays saturation, thereby improving the DC biased characteristics. As the non-magnetic body used as the first gap 150, there are Cu, Zn, Fe, or the like.

Further, the second gap 160 is located between the multilayered body sheets and the second gap 160 made of a dielectric material is formed on a layer different from the first gap 150. The second gap 160 made of a dielectric material does not allow a diffusion to the magnetic body and therefore, may be formed of a thin thickness without increasing the loss coefficient of a material.

As such, the multilayer inductor 100 according to the exemplary embodiment of the present invention complexly uses the first gap 150 made of a non-magnetic material and the second gap 160 made of the dielectric material, thereby remarkably improving the DC biased characteristics without reducing the breaking strength of the inductor.

Figure 3:
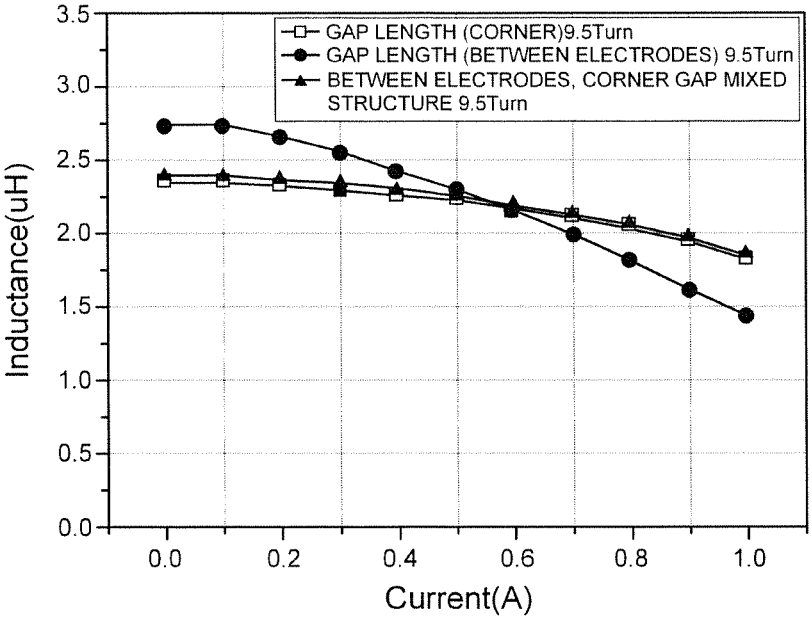
FIG. 3 is a graph showing characteristics of the multilayer inductor according to the exemplary embodiment of present invention.

FIG. 3 is a graph showing the characteristics of the multilayer inductor according to the exemplary embodiment of the present invention, wherein ■ line shows the characteristics of the inductor in which the gap is formed from the center of the coil part to both ends of the laminate and ● line shows the characteristics of the inductor in which the gap is formed from the center of the coil part to the inner side thereof. Further, ▲ line shows the inductor characteristics of the present invention complexly using the gap of the non-magnetic material and the gap of the dielectric material.

It can be appreciated from FIG. 3 that the DC biased characteristics of the inductor ■ in which the gap is formed from the center of the coil part to both ends of the laminate is more excellent than that of the inductor ● in which the gap is formed from the center of the coil part to the inner side thereof. It can be appreciated that the inductor ▲ of the exemplary embodiment of the present invention shows the more excellent DC biased characteristics than those of the inductor ■ in which the gap is formed from the center of the coil part to both ends of the laminate.

Here, the first gap 150 may be formed to have a thickness sufficient to contact the internal electrode patterns 130 located on the top portion thereof and the internal electrode patterns 130 located on the bottom portion thereof and may be also located to contact the internal electrode patterns 130 located on the top portion thereof, simultaneously.

Further, the second gap 160 may be formed from the center of the coil part 140 to the inner side thereof or the center of the coil part 140 to the outer side thereof. Further, the second gap 160 may be printed on any one of the top surface and the bottom surface of the body sheet.

Meanwhile, in the multilayer inductor according to another exemplary embodiment of the present invention, the first gap 150 made of the non-magnetic material and the second gap 160 made of the dielectric material may be located on the same layer.

Further, the first gap 150 may be located at both ends of the second gap 160 and the second gap 160 may be formed from the center of the coil part 140 to the outer side thereof or the center of the coil part 140 to the inner side thereof.

Further, the second gap 160 may be located at both ends of the first gap 150 and the first gap 150 may be formed from the center of the coil part 140 to the outer side thereof or the center of the coil part 140 to the inner side thereof.

In addition, the first gap 150 and the second gap 160 may be formed to have a thickness sufficient to contact the internal electrode patterns 130 located on the top portions thereof and the internal electrode patterns 130 located on the bottom portions thereof, simultaneously.

FIGS. 4A to 4L are diagrams showing in detail several exemplary embodiments of the present invention ad described above. The exemplary embodiments of the present invention will be described with reference to FIGS. 4A to 4L. For reference, the multilayer inductor shown in FIGS. 4A to 4L has a difference in the shape of the first gap 150 and the second gap 160 and therefore, only the first gap 150 and the second gap 160 will be described below.

Figure 4A:
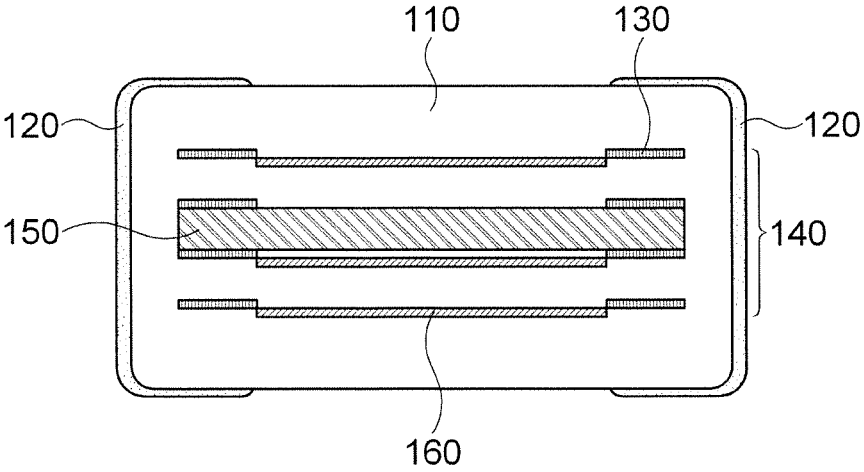
FIGS. 4A to 4L are cross-sectional views of the multilayer inductor according to the embodiment of the present invention.

Referring to FIG. 4A, in the multilayer inductor according to the exemplary embodiment of the present invention, the first gap 150 made of the non-magnetic material is formed to both ends of the laminate 110 and the first gap 150 may be formed to have a thickness sufficient to contact the internal electrode patterns located on the top portion thereof and the internal electrode patterns located on the bottom portion thereof, simultaneously. Further, the second gap 160 made of the dielectric material may be formed from the center of the coil part 140 to the inner side thereof.

Figure 4B:
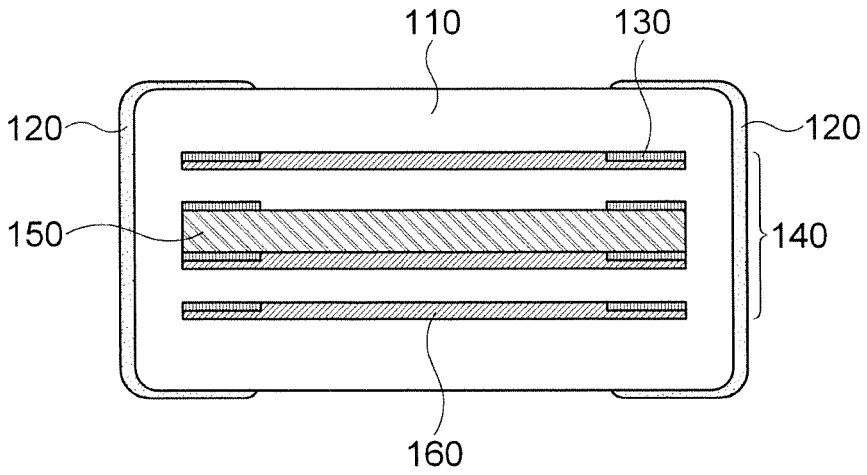

Referring to FIG. 4B, in the multilayer inductor according to the exemplary embodiment of the present invention, the first gap 150 made of the non-magnetic material is formed to both ends of the laminate 110 and the first gap 150 may be formed to have a thickness sufficient to contact the internal electrode patterns located on the top portion thereof and the internal electrode patterns located on the bottom portion thereof, simultaneously. Further, the second gap 160 made of the dielectric material may be formed from the center of the coil part 140 to the outer side thereof or the center of the coil part 140 to the inner side thereof.

Figure 4C:
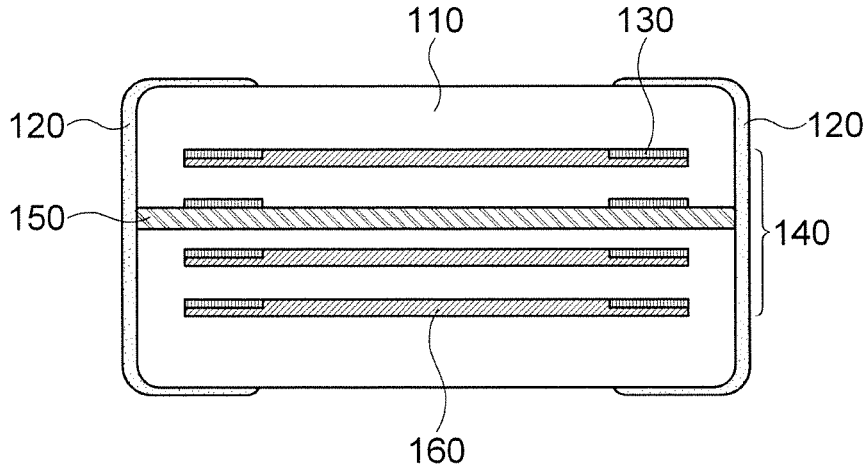

Referring to FIG. 4C, in the multilayer inductor according to the exemplary embodiment of the present invention, the first gap 150 made of the non-magnetic material may be formed to both ends of the laminate 110 and is located to contact the internal electrode patterns 130 located on the top portion thereof. Further, the second gap 160 made of the dielectric material may be formed from the center of the coil part 140 to the outer side thereof or the center of the coil part 140 to the inner side thereof.

Figure 4D:
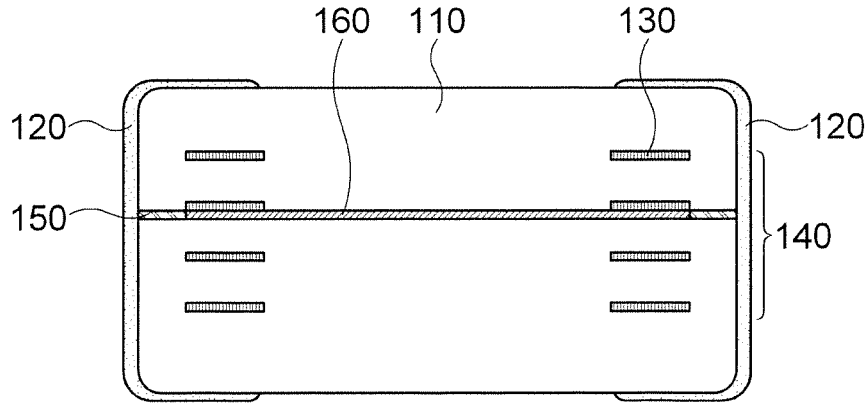

Referring to FIG. 4D, in the multilayer inductor according to the exemplary embodiment of the present invention, the first gap 150 made of the non-magnetic material and the second gap 160 made of the dielectric material are located on the same layer and the second gap 160 may be formed from the center of the coil part 140 to the outer side thereof and the first gap 150 may be formed at both ends of the second gap 160.

Figure 4E:
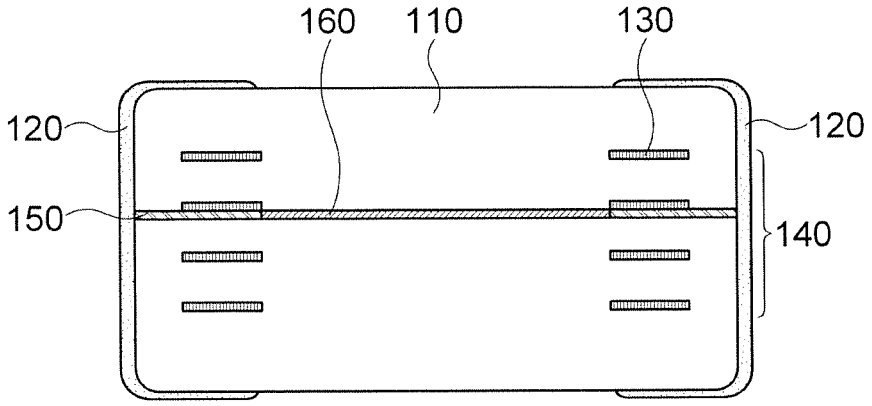

Referring to FIG. 4E, in the multilayer inductor according to the exemplary embodiment of the present invention, the first gap 150 made of the non-magnetic material and the second gap 160 made of the dielectric material are located on the same layer and the second gap 160 may be formed from the center of the coil part 140 to the inner side thereof and the first gap 150 may be formed at both ends of the second gap 160.

Figure 4F:
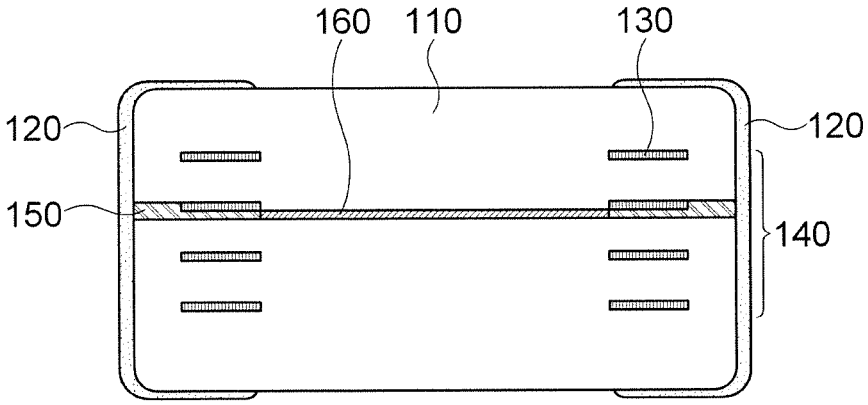

Referring to FIG. 4F, in the multilayer inductor according to the exemplary embodiment of the present invention, the first gap 150 made of the non-magnetic material and the second gap 160 made of the dielectric material are located on the same layer and the second gap 160 may be formed from the center of the coil part 140 to the inner side thereof and the first gap 150 may be formed at both ends of the second gap 160. Further, the first gap 150 may be further formed from the outer side of the coil part 140 to both ends of the laminate 110.

Figure 4G:
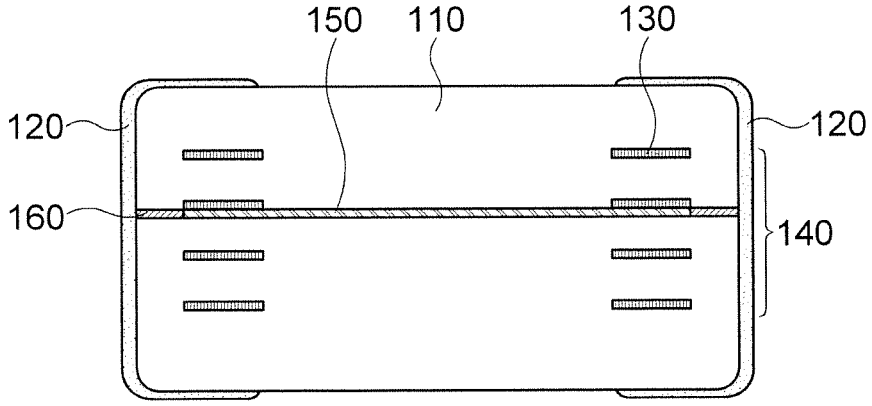

Referring to FIG. 4G, in the multilayer inductor according to the exemplary embodiment of the present invention, the first gap 150 made of the non-magnetic material and the second gap 160 made of the dielectric material are located on the same layer and the first gap 150 may be formed from the center of the coil part 140 to the outer side thereof and the second gap 160 may be formed at both ends of the first gap 150.

Figure 4H:
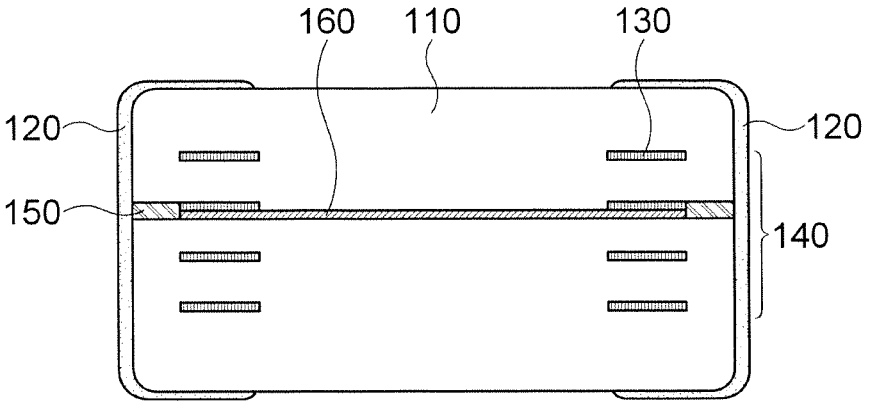

Referring to FIG. 4H, in the multilayer inductor according to the exemplary embodiment of the present invention, the first gap 150 made of the non-magnetic material and the second gap 160 made of the dielectric material are located on the same layer and the second gap 160 may be formed from the center of the coil part 140 to the outer side thereof and the first gap 150 may be formed at both ends of the second gap 160. Further, the first gap 150 may be further formed from the outer side of the coil part 140 to both ends of the laminate 110.

Figure 4I:
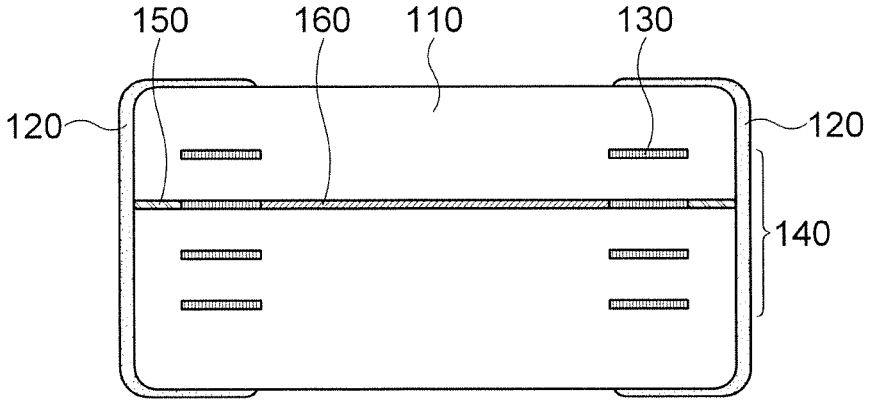

Referring to FIG. 4I, in the multilayer inductor according to the exemplary embodiment of the present invention, the first gap 150 made of the non-magnetic material and the second gap 160 made of the dielectric material are located on the same layer and the second gap 160 may be formed from the center of the coil part 140 to the inner side thereof and the first gap 150 may be formed from the outer side of the coil part 140 to both ends of the laminate 110.

Figure 4J:
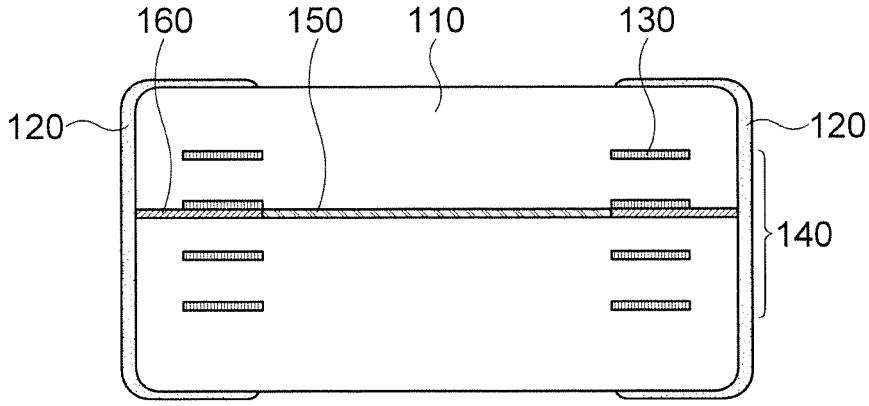

Referring to FIG. 4J, in the multilayer inductor according to the exemplary embodiment of the present invention, the first gap 150 made of the non-magnetic material and the second gap 160 made of the dielectric material are located on the same layer and the first gap 150 may be formed from the center of the coil part 140 to the inner side thereof and the second gap 160 may be formed at both ends of the first gap 150.

Figure 4K:
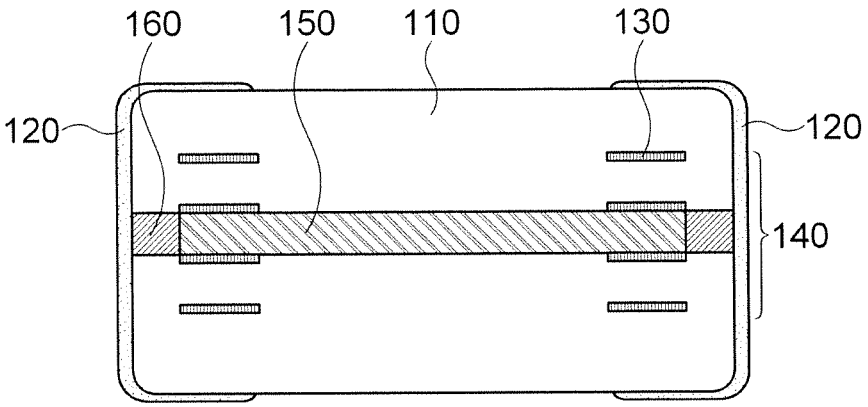

Referring to FIG. 4K, in the multilayer inductor according to the exemplary embodiment of the present invention, the first gap 150 made of the non-magnetic material and the second gap 160 made of the dielectric material are located on the same layer and the first gap 150 may be formed from the center of the coil part 140 to the outer side thereof and the second gap 160 may be formed at both ends of the first gap 150. In addition, the first gap 150 and the second gap 160 may be formed to have a thickness sufficient to contact the internal electrode patterns located on the top portions thereof and the internal electrode patterns located on the bottom portions thereof, simultaneously.

Figure 4L:
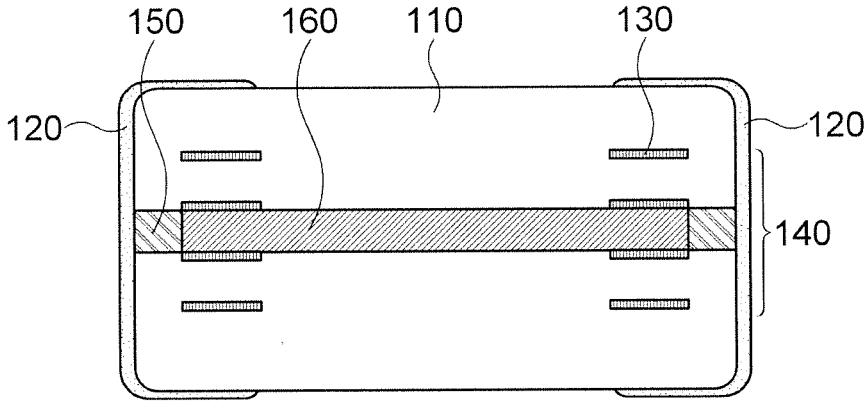

Referring to FIG. 4L, in the multilayer inductor according to the exemplary embodiment of the present invention, the first gap 150 made of the non-magnetic material and the second gap 160 made of the dielectric material are located on the same layer and the second gap 160 may be formed from the center of the coil part 140 to the outer side thereof and the first gap 150 may be formed at both ends of the second gap 160. In addition, the first gap 150 and the second gap 160 may be formed to have a thickness sufficient to contact the internal electrode patterns located on the top portions thereof and the internal electrode patterns located on the bottom portions thereof, simultaneously.

According to the multilayer inductor according to the exemplary embodiment of the present invention, the DC biased characteristics can be remarkably improved without reducing the breaking strength of the inductor, by complexly using the gap of the non-magnetic material and the gap of the dielectric material.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

Accordingly, the scope of the present invention is not construed as being limited to the described embodiments but is defined by the appended claims as well as equivalents thereto.

What is claimed is:

1. A multilayer inductor, comprising:

a laminate on which a plurality of body sheets are multilayered;

a coil part configured to have internal electrode patterns formed on the body sheet;

a first gap made of a non-magnetic material located between the multilayered body sheets;

a second gap made of a dielectric material located between the multilayered body sheets and located on the same layer as the first gap; and external electrodes formed on both surfaces of the laminate and electrically connected with both ends of the coil part, wherein the first gap is located at both ends of the second gap, wherein the second gap is formed from a center of the coil part to an inner side thereof, and wherein the second gap is made of material different than that of the first gap.

2. The multilayer inductor according to claim 1, wherein the second gap is located at both ends of the first gap.

3. The multilayer inductor according to claim 2, wherein the first gap is formed from a center of the coil part to an outer side thereof.

4. The multilayer inductor according to claim 2, wherein the first gap is formed from a center of the coil part to an inner side thereof.

5. The multilayer inductor according to claim 1, wherein the first gap is formed to have a thickness sufficient to contact internal electrode patterns located on a top portion thereof and the internal electrode patterns located on a bottom portion thereof, simultaneously.

6. The multilayer inductor according to claim 1, wherein the second gap is formed to have a thickness sufficient to contact internal electrode patterns located on a top portion thereof and the internal electrode patterns located on a bottom portion thereof, simultaneously.

7. The multilayer inductor according to claim 1, wherein the first gap is made of a non-magnetic material having at least one selected from the group consisting of copper (Cu), zinc (Zn), and iron (Fe).

* * * * *